US009534366B2

(12) United States Patent
Medina

(10) Patent No.: US 9,534,366 B2
(45) Date of Patent: Jan. 3, 2017

(54) TOILET CLEANING DEVICE

(71) Applicant: Kirill Rapoport, Brooklyn, NY (US)

(72) Inventor: Carlos Coll Medina, Barcelona (ES)

(73) Assignee: Kirill Rapoport, Brooklyn, NY (US)

( * ) Notice: Subject to any disclaimer, the term of this patent is extended or adjusted under 35 U.S.C. 154(b) by 125 days.

(21) Appl. No.: 13/730,280

(22) Filed: Dec. 28, 2012

(65) Prior Publication Data

US 2014/0123375 A1 May 8, 2014

(51) Int. Cl.
*A47K 17/00* (2006.01)
*E03D 9/00* (2006.01)

(52) U.S. Cl.
CPC ..... *E03D 9/00* (2013.01); *A47K 17/00* (2013.01)

(58) Field of Classification Search
CPC ..... E03D 9/00; E03D 9/02; A47K 11/10; A47K 17/00; E03C 1/30
USPC ..... 4/661, 222, 223, 287, 286, 294, 686, 687,4/650–654
See application file for complete search history.

(56) References Cited

U.S. PATENT DOCUMENTS 904,539 A * 11/1908 Koenig ..... 4/681
1,351,368 A * 8/1920 Burns ..... E03C 1/306 285/239
2,065,347 A * 12/1936 Schulse ..... 4/654
2,266,043 A * 12/1941 Hutchins ..... 4/687
2,398,921 A * 4/1946 Cook ..... E03C 1/244 4/694
2,523,634 A * 9/1950 Pyle ..... 137/593
2,560,954 A * 7/1951 Jackson ..... 4/680
2,988,755 A * 6/1961 Roland ..... 4/654
3,480,021 A * 11/1969 Ewald, Jr. ..... A47K 17/00 134/24
3,839,744 A * 10/1974 Ziegelmeyer et al. ..... 4/661
4,112,527 A * 9/1978 Giubilo ..... 4/253
4,137,577 A * 2/1979 Maxfield ..... E03D 9/02 4/222
5,979,492 A * 11/1999 Miller ..... 137/426
6,049,918 A * 4/2000 White, Sr. ..... 4/222
6,467,105 B1 * 10/2002 Vanden Elzen ..... 4/680
8,314,318 B2 * 11/2012 Brockman ..... G10D 9/043 84/386

FOREIGN PATENT DOCUMENTS

CH 606645 A5 * 11/1978 ..... E03C 1/22

OTHER PUBLICATIONS

International Search Report for WO2014074121.*

* cited by examiner

*Primary Examiner* — Erin Deery
(74) *Attorney, Agent, or Firm* — Henry M. Feiereisen LLC.

(57) ABSTRACT

A toilet cleaning device has an element which closes an outlet pipe of a toilet bowl so that water accumulates in the toilet bowl to clean it and then allows the water to flow out through the outlet pipe, and the element includes a base which closes the outlet pipe of the toilet bowl and a tube connected with the base and capable of being grabbed by a user.

3 Claims, 4 Drawing Sheets

TOILET CLEANING DEVICE

CROSS REFERENCE TO A RELATED APPLICATION

This application contains the subject matter of Spanish patent application No. U201231183 filed on Nov. 8, 2012. The present application claims its priority from this Spanish patent application under 35 USC 119 (a)-(d).

BACKGROUND OF THE INVENTION

The present invention generally relates to toilet cleaning devices.

More particularly the present invention relates to a toilet cleaning device that allows effective and comfortable cleaning and disinfection by the user, without direct use of hands.

In current status of techniques it is known that typical toilets or water bowls are used for hygienic needs of the user.

Those toilets, by self-nature of their use, are susceptible to need to proceed with their cleaning and disinfection, because otherwise, they are a foci of bad odors and dirtiness, not only in the household, but also particularly in places of transit and public use, such as hotels, ships, airplanes, etc.

The aforementioned cleaning and disinfection becomes especially problematic in the case of internal and lower edge area of the toilets, where water from the cistern is discharged.

It is therefore believed to be advisable to develop devices which will allow an effective cleaning and disinfection of known toilets and toilet bowls

SUMMARY OF THE INVENTION

Accordingly it is an object of the present invention to provide a new and efficient toilet cleaning device.

More particularly it is an object of the present invention to provide a toilet cleaning device which allows attaining an effective cleaning and disinfection of known toilets and water bowls, in a simple manner and completely effective, and particularly of internal and lower edge area of a toilet, and without the need of direct use of hands.

In keeping with these objects and with others which will become apparent hereinafter, one feature of the present invention resides, briefly stated, in a toilet cleaning device which has an element configured to close an outlet pipe of a toilet so as to allow water to accumulate in the toilet for cleaning the toilet and then to flow out through the outlet pipe.

In accordance with another feature of the present invention, this element can have a base and a tube, the base being adapted as to shape and outline for blocking of an outlet pipe or a U-bend of the toilet, while the tube being attached to the base and the tube also can be grabbed by a user.

In accordance with a further feature of the present invention, the tube can extend through the base and have two ends, with an opening located on one of the tube's ends, and an opening located at the other end, with the opening of one of the tube's end in communication with the opening located at the other end of the same tube, and in such manner that the openings communicate different sides of the base.

Still a further feature of the present invention is that in the toilet cleaning device the tube can be flexible, or the base can be flexible, or both the tube and the base can be flexible.

In accordance with still a further feature of the present invention, the toilet cleaning device can be provided with means for regulation of water evacuation from the toilet through the tube.

The inventive means for regulation can include a plurality of orifices positioned along the tube and a sliding annular pin able to be positioned on the exterior along the tube, and also able to be rotated on the tube, that also has at least one perforation, and the axis of the pin always coincides axis of the tube.

The present invention provides the possibility of performing the cleaning of the classic and known toilets, always susceptible to the need of a cleaning after successive uses, in a simple and effective manner, without the need of direct use of hands, and in a very comfortable way, adaptable to any type of toilet, independent of shape or size, and above all, adaptable in particular to the toilet's internal and lower edge area where water discharge from the cistern is distributed.

Other features and advantages of the toilet cleaning device, purpose of this invention, will be evident from the description of the preferred embodiments, which are not exclusive, and illustrated as a non-limiting example in attached drawings.

DESCRIPTION OF THE PREFERRED EMBODIMENTS

The toilet cleaning device in accordance with a present invention has an element which is configured, formed and shaped so that, when it is placed in a toilet bowl, it closes an outlet pipe of the toilet bowl, allows water to accumulate in the toilet bowl for cleaning of the latter, and then allows water to be drained through the outlet pipe of the toilet bowl.

As shown in the figures, the above mentioned element of the inventive toilet cleaning device essentially includes a base 1 and a tube 2. The base is adapted in shape and outline for blocking an outlet pipe or U-bend 5 of a toilet 6, and the tube 2 is joined to the base to extend through the base, and also the tube 2 can be grabbed by a user.

Figure 1:
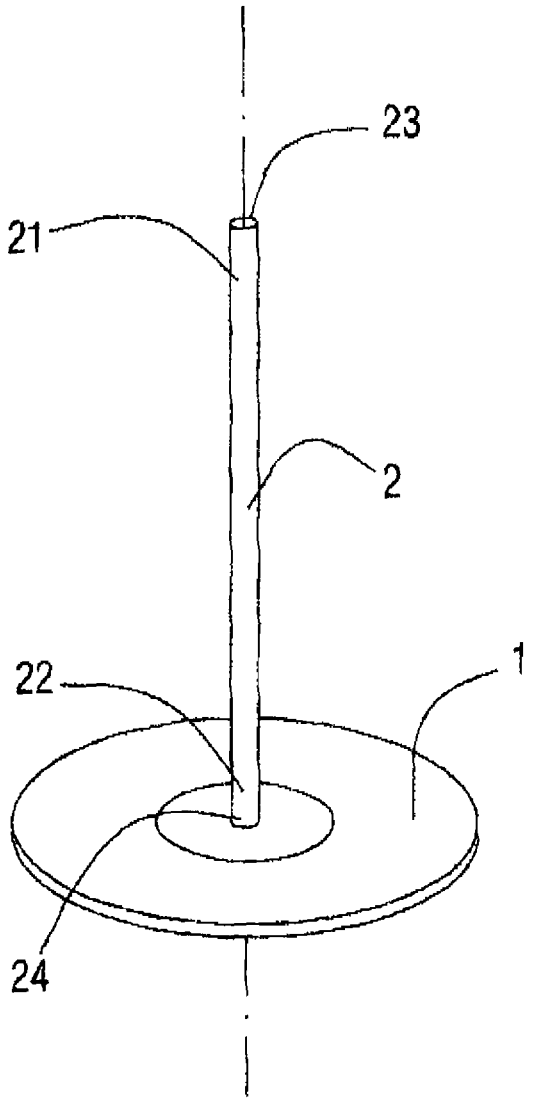
FIG. 1 is a view of the toilet cleaning device in accordance with the present invention, before proceeding with its use.

As can be appreciated in FIG. 1, the element of the toilet cleaning device consists of the base 1 and the tube 2 as mentioned hereinabove.

Base 1 is specifically fitted out, for example because of its flexible nature, to be able to block U-bend 5 usually present in classic toilets 6. The base 1 can be flexible for example because of its material, its shape, and both.

Tube 2 is formed so that it can be grabbed by the user, and has upper and lower ends 21 and 22. It is joined to the base by end 22 in a substantially perpendicular manner to it. In addition it can pass through base 1. The Tube 2 can be also flexible.

In accordance with other embodiments of realization, base 1 and tube 2 may have inclinations between them different than those described here.

Tube 2 has upper opening 23 located at upper end 21 of tube 2, and another lower opening 24 located at the other lower end 22. The opening 23 of end 21 of tube 2 is in communication with the other opening 24 located at the other end 22 of same tube 2, and can be on the other side of base 1, because tube 2 passes through base 1.

Figure 2:
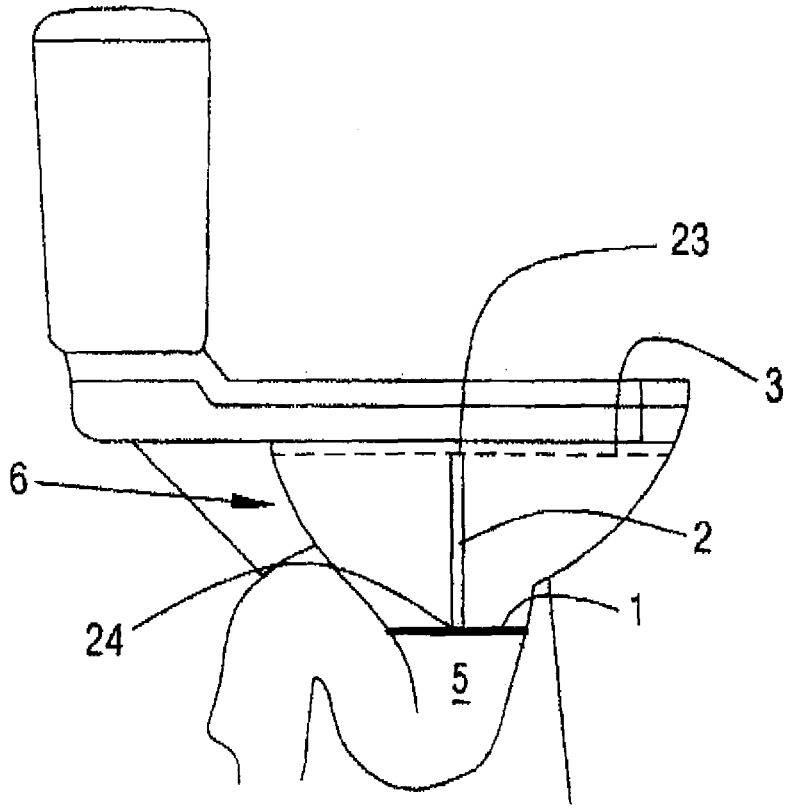
FIG. 2 is a view of the toilet cleaning device in accordance with the present invention, already placed for its use

To position the device on toilet 6, the user can grab tube 2, and by its handling, proceed with location of base 1 at outlet pipe or U-bend 5 of toilet 6, insuring that its shape and outline blocks U-bend 5 of toilet 6, as it appears represented in FIG. 2.

Then the cleaning process proceeds with the emptying of the contents of the cistern in toilet 6, and upon pouring of the water in usual manner, and having U-bend 5 blocked by base 1, bowl of the toilet 6 will fill up with water. The water's own weight and pressure will contribute to further anchoring of base 1 for blocking of U-bend 5.

The toilet bowl filling of water will reach a maximum level 3 of height (represented by traces in FIG. 2) limited by the position of opening 23 located at end 21 of tube 2, because then water will escape through opening 23 that is in communication with opening 24 of same tube 2, which is on the other side of base 1, and may then pass through base 1 and go out through U-bend 5, avoiding spillage to exterior of toilet 6.

When toilet 6 is already filled with water up to level 3 of height indicated, the user may proceed to pour a specific cleaning product that he/she deems adequate to that effect, to be dissolved in the accumulated water, and in place for a while for cleaning and disinfection of toilet 6, and particularly the toilet's internal and lower edge area where water discharge from the cistern is distributed.

Figure 3:
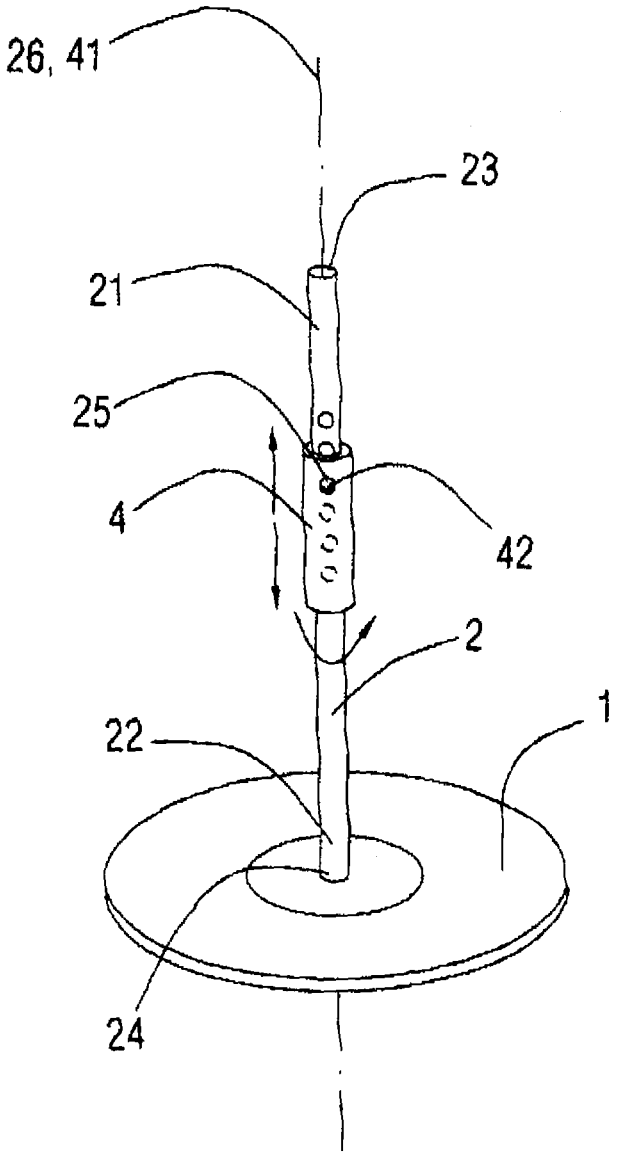
FIG. 3 is a view of the toilet cleaning device in accordance with another embodiment, before proceeding with its use.

Alternatively to embodiment of realization, in another embodiment of realization shown in FIG. 3, tube 2 has available means of regulation that allow to regulate the water level 3 height in toilet 6 upon filling up, after its blocking by base 1.

In this embodiment of realization, means for regulation are carried out by a plurality of orifices 25 located along tube 2, and an annular pin 4 with its axis coinciding with the axis 26 of tube 2. The annular pin 4 can be slid and positioned along tube 2, according to the direction indicated by the arrows. Pin 4 also has a perforation 42.

Upon sliding and rotating pin 4, coinciding its perforation 42 with any of orifices 25 of tube 2, one orifice 25 of tube 2 will be uncovered, and the remainder of orifices 25 will be capped (represented by traces in FIG. 3) by pin 4 itself, or will be above that orifice 25 coinciding with perforation 42 of pin 4.

Figure 4:
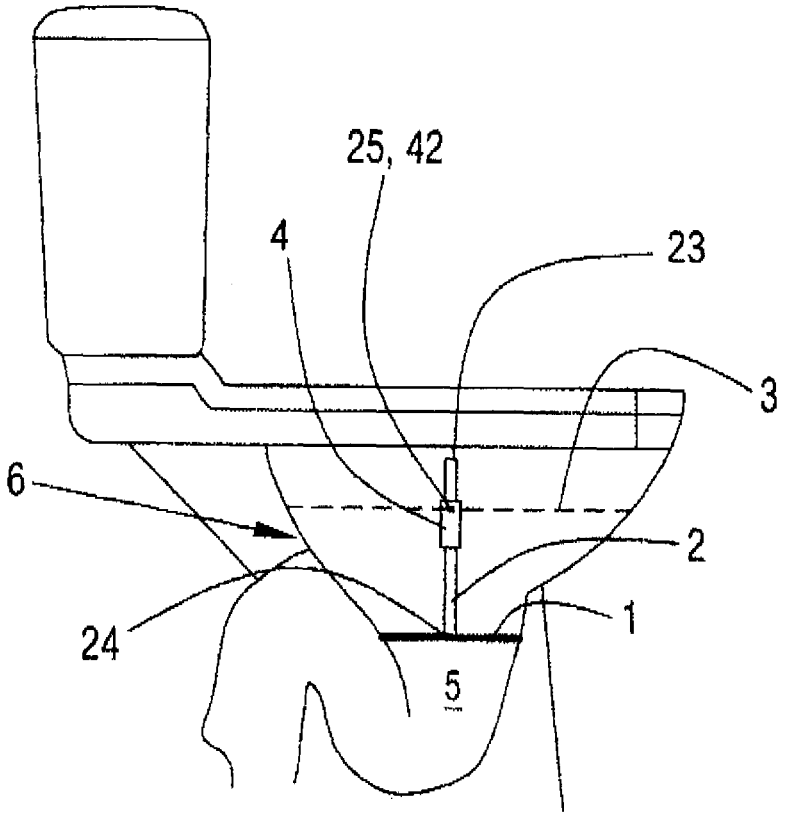
FIG. 4 is a view of the toilet cleaning device in accordance with a further embodiment, already placed for its use.

As appreciated in FIG. 4, upon proceeding with the fill up of water in toilet bowl, level 3 of fill up (represented by traces in FIG. 4) will reach as maximum the height limited by the position of orifice 25 uncovered of tube coinciding with perforation 42 of pin 4, because then the water will evacuate through that orifice 25 towards opening 24 of tube 2, and go out through U-bend 5, avoiding spillage to exterior of toilet 6.

Therefore, the water level 3 height in toilet 6 may be regulated after blocking U-bend 5, and proceed with its fill up, because whether or not it is orifice 25 uncovered by its coinciding with perforation 42 of pin 4, water will escape through that orifice 25, and will reach the level 3 marked by it.

Also the pin 4 can be turned and positioned so that no orifice 25 will coincide with its perforation 42. In this case, water will escape through opening 23 of tube 2, as has been explained for the case represented in FIG. 2.

Then, after cleaning of toilet 6, the user may proceed to remove the device. For this purpose, the user must, upon grabbing tube 2 perform a simple movement to one side and pull the tube to counteract any possible suction effect, and so remove base 1 from U-bend 5, and water contained be emptied by U-bend 5 in the usual manner.

Toilet 6 will be completely clean and disinfected, even the most embedded dirt will be eliminated, leaving it available for its usual use, and to the point, the toilet's internal and lower area where water discharge from the cistern is distributed.

Base 1, due to its disposition, shape and flexible nature, is adaptable to blocking of a U-bend 5 for a plurality of known toilets 6.

Base 1 and tube 2 of the toilet cleaning device in accordance with the present invention may be also co-joined, making both of them a single set or piece.

In this manner, the toilet cleaning device allows the possibility to carry out the cleaning of classic and known toilets 6, always susceptible to the need of a cleaning after successive uses, in a simple and effective way, without the need of direct use of hands, and in a very comfortable manner, adaptable to any type of toilet 6, independent of shape or size. In addition, the cleaning will be especially effective and adequate for the toilet's internal and lower edge area where water discharge from the cistern is distributed.

The details, shapes, dimensions, and other accessory elements, as well as the materials used in the manufacturing of the toilet cleaning device of the invention may be conveniently substituted by others that are technically equivalent and do not deviate from the invention's essentiality nor the features defined by the claims included below.

The invention claimed is:

1. A toilet cleaning device, comprising an element including a base configured to close an outlet pipe of a toilet so as to allow water to accumulate in the toilet above the base, and a tube having a vertical axis, connected with the base and having upper and lower ends provided with upper and lower openings which communicate with each other, so that when water accumulates in the toilet above the base and reaches the upper opening it flows through the tube and discharges through the lower opening of the tube into the outlet pipe of the toilet, said tube having a plurality of orifices spaced from one another along the tube in an axial direction; and an annular pin arranged on the tube and slidable along the tube in the axial direction, said annular pin having a single perforation which during sliding of the annular pin along the tube in the axial direction can coincide with one of the orifices of the tube so that water accumulated above the base flows from the toilet into the tube through the one orifice of the tube and the single perforation of the annular pin which coincides with the one orifice of the tube and then flows out of the tube, thereby a height of water above the base in the toilet is regulated.

2. The toilet cleaning device of claim 1, wherein the element is flexible as a whole.

3. The toilet cleaning device of claim 1, wherein the tube of the element is flexible.

* * * * *